US010096200B2

(12) United States Patent
Ditton

(10) Patent No.: US 10,096,200 B2
(45) Date of Patent: Oct. 9, 2018

(54) GAMING MACHINE AND METHOD OF PLAY WITH SPLIT-FLAP REELS

(71) Applicant: Incredible Technologies, Inc., Vernon Hills, IL (US)

(72) Inventor: Richard Ditton, Kildeer, IL (US)

(73) Assignee: INCREDIBLE TECHNOLOGIES, INC., Vernon Hills, IL (US)

( * ) Notice: Subject to any disclaimer, the term of this patent is extended or adjusted under 35 U.S.C. 154(b) by 19 days.

(21) Appl. No.: 14/973,029

(22) Filed: Dec. 17, 2015

(65) Prior Publication Data

US 2016/0180639 A1 Jun. 23, 2016

Related U.S. Application Data

(60) Provisional application No. 62/093,064, filed on Dec. 17, 2014.

(51) Int. Cl.
*G07F 13/00* (2006.01)
*G07F 17/32* (2006.01)

(52) U.S. Cl.
CPC ..... *G07F 17/3213* (2013.01); *G07F 17/326* (2013.01)

(58) Field of Classification Search
None
See application file for complete search history.

(56) References Cited

U.S. PATENT DOCUMENTS 5,941,772 A * 8/1999 Paige ..... G07F 17/34 273/143 R
2008/0182647 A1* 7/2008 Brunet De Courssou ..... G07F 17/3211 463/20
2009/0137309 A1* 5/2009 Thomas ..... G07F 17/3211 463/20
2009/0186684 A1* 7/2009 Visser ..... G07F 17/3267 463/20
2013/0157742 A1* 6/2013 Pacey ..... G07F 17/3211 463/20
2014/0087827 A1* 3/2014 Nicely ..... G07F 17/3267 463/20
2016/0078710 A1* 3/2016 Pierer ..... G07F 17/3211 463/31

* cited by examiner

*Primary Examiner* — Jason Yen
(74) *Attorney, Agent, or Firm* — Husch Blackwell LLP; George S. Pavlik

(57) ABSTRACT

An electronic gaming machine has a virtual reel with a plurality of predetermined fixed game elements. Each gaming element of the plurality of gaming elements is displayable in a visual viewing position when in an in-play orientation. When in the in-play orientation each game element has a depiction, when in said visual viewing position, which differs from another depiction of that same game element when that same game element is displayed in the in-play orientation in said visual viewing position. Virtual flaps provide for the differing depictions.

6 Claims, 9 Drawing Sheets

GAMING MACHINE AND METHOD OF PLAY WITH SPLIT-FLAP REELS

CROSS-REFERENCE TO RELATED APPLICATION

This application claims the benefit of U.S. Provisional Patent Application 62/093,064 filed Dec. 17, 2014, the entirety of which is hereby incorporated by reference as if fully set forth herein.

FIELD

The subject invention pertains generally to an improved electronic gaming machine ("EGM") and method of play, and more particularly to a method and machine for enhancing play by providing game elements on a virtual split-flap reel.

BACKGROUND

Electronic gaming machines are generally well-known and have been relatively popular and profitable for a number of years. Such machines can be configured to offer a variety of casino or entertainment games, including for example mechanical or electromechanical slot-type matching games, video games or electronic casino games, such as video poker, blackjack, keno, roulette, etc. As is generally known, such machines can accept wagers and compute a random game outcome from a group of potential outcomes. Some random outcomes can include both predetermined winning and non-winning/losing outcomes with winning outcomes paying a multiple of a wager back to the player and non-winning outcomes paying nothing.

As is generally known, the nature and format of such games have certain limitations with respect to the manner in which the machine displays game elements when the game is in play. In particular, the rate over time at which the displayed game elements switch from one to the other decreases when the game starts in-play mode to stop of the in-play mode. The rate of switching is zero when the game element is set in a game position and the win or loss is assessed to determine the outcome. Also the number and presentation of winning and non-winning outcomes is limited. It has been recognized that due to such limitations, player interest in such games can decrease over a period of time which may result in certain players discontinuing play of the game and/or declining to play such games in the future. Thus, there are on-going needs to try to bring enhanced play excitement to the audience of players in order to sustain their interest and desire to continue playing.

DETAILED DESCRIPTION

Figure 1:
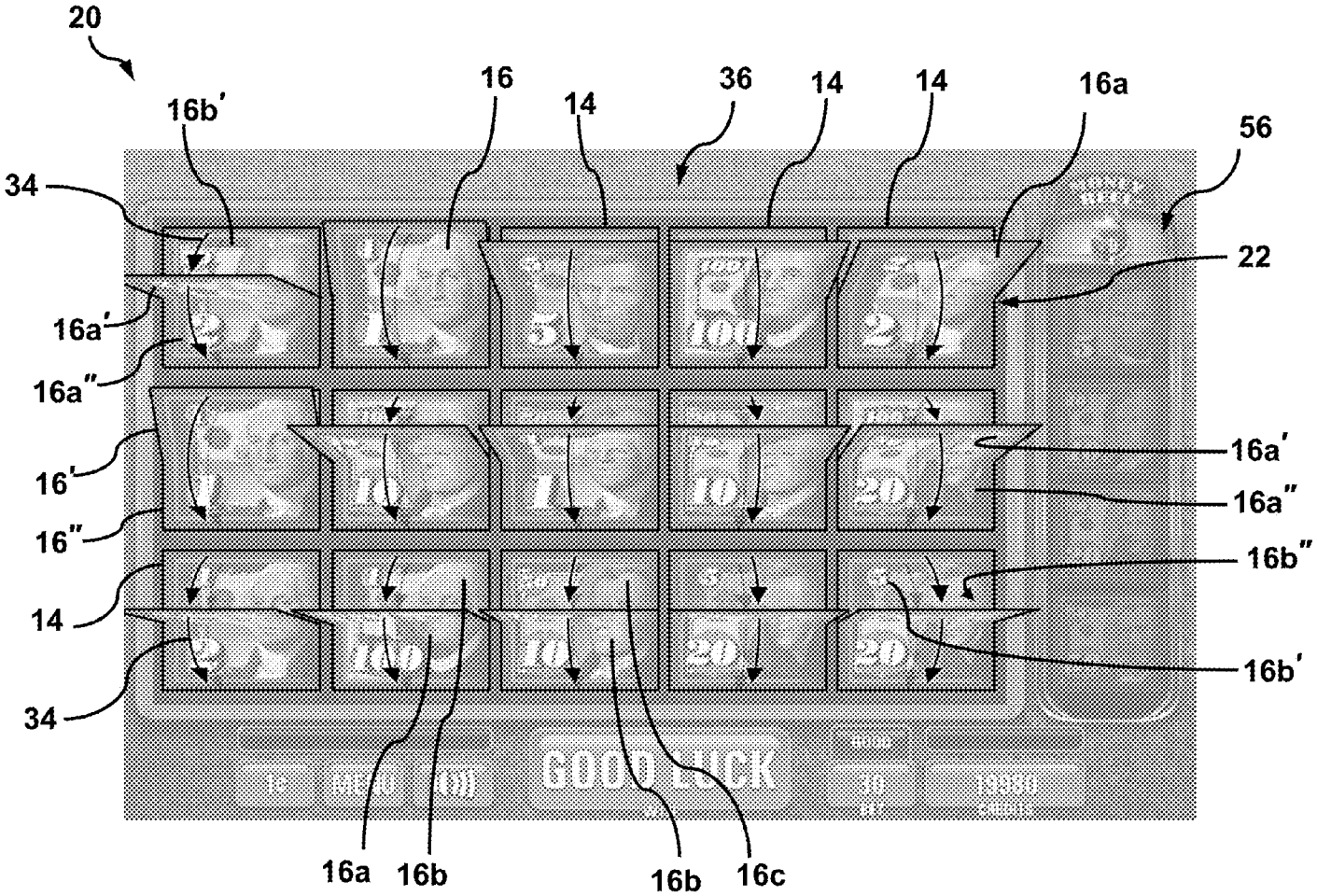
FIG. 1 is a front view of a game display according to embodiments presented herein, wherein virtual reels and game elements of the main array are in play.

The subject invention is susceptible of embodiment in many different forms. Exemplary embodiments are shown in the drawings, and will be described herein in specific detail. Accordingly, the present disclosure is to be considered as an exemplification of the principles of the invention and is not intended to limit the invention to the specific embodiments illustrated. For example, although the following disclosure describes embodiments in connection with a traditional slot-type electronic game, it will be recognized that the embodiments can also be practiced as part of alternative types of games or platforms including, for example, online gaming systems played on any electronic device (including, but not limited to, a computer, tablet or smartphone, that can be connected to an electronic network). It will further be understood that embodiments described herein can be carried out or implemented in connection with games or gaming machines that do not require wagers from a player, such as for example arcade or amusement-type games.

Generally, embodiments of the subject invention relate to a gaming machine (EGM) 12 and method of play featuring a game display 20 having a plurality of virtual reels 14; each virtual reel 14 has a plurality of predetermined game elements 16. A game element 16 can be an image, symbol, photo or any other indicia that can be visually perceptible to a user or player of the game. For exemplary purposes, FIGS. 1-5 illustrate game elements 16 as being images representative of United States currency, with different symbols having different currency denominations. It will be understood, however, by persons of ordinary skill in the art, that embodiments presented herein can feature, use or display different types of game elements without departing from the scope of the subject invention.

As illustrated in FIGS. 1-5, game elements 16 on a reel 14 can be displayable in a substantially stationary game orientation 18. When an element 16 is in the game orientation 18, the game element 16 is displayed in a viewable position for the operator to view and in a position on the array which can be determinative as to whether the element is part of, or going to be part of, a winning or a losing outcome of displayed game elements 16.

Game elements 16 of a reel 14 can also be visually displayable to an operator in an in-play orientation 22. When in an in-play orientation 22, a game element 16 can be in a viewable position and the reel 14 and element virtually appear to be in motion. When a game element 16 is in an in-play orientation 22, the game, reel 14 and element can be in-play before settling in the game orientation 18. At least some, and preferably all, of the game elements 16, when in an in-play orientation 22, comprise a visually variable depiction 24 viewable to an operator in the viewable position.

The depiction 24 is generally a variable image of the game element 16. The visually variable depiction 24 of a game element can be selectable from at least one, and preferably a plurality of, differing depictions 26 of the game elements 16. Each of the depictions 26 of a game element 16 can be displayed in series over time when the game element 16 is in-play and in the viewable in-play orientation 22. In addition, each differing depiction 26 of a game element 16 can be different from the depiction of the game element 16 when the element is in the game orientation 18. Each differing depiction 26 can also vary from each other. A game element 16, when in the in-play orientation 22, can also comprise a depiction which is the same as the depiction when the element is in the game orientation 18.

The plurality of differing depictions 26 of a game element 16 can be part of at least one, and preferably a plurality, of composite depictions each of which differs from the other. At least some, and preferably all, of the composite depictions can include a depiction of an additional game element 16*b* from the plurality of game elements 16 on a reel 14 in addition to a depiction of the game element 16*a* from the plurality on the reel 14. The game element 16*a* in this context can be described as including a first game element 16*a* of the plurality and an additional game element 16*b* can be described as a second game element 16*b* of the plurality of game elements.

Like the first game element 16*a* described above, the second game element 16*b*, when in the in-play orientation 22, comprises a visually variable depiction 24 like the first game element 16*a*. A composite depiction includes the second game element 16*b* and includes a depiction of still an additional game element 16 of the plurality. The additional element 16 in this context can be a third game element 16*c*. All of the game elements 16 on the virtual reel 14 can have variable depictions like the depictions for game elements 16*a*, 16*b*, 16*c* and can form part of a composite depiction.

In order to provide a virtual reel 14 with game elements 16 which can form part of composite depictions, each virtual reel 14 can comprise one or more virtual flaps 30. Each respective game element 16 of the plurality game elements of a reel 14 can have a first respective portion 16' depicted on a face of a first respective flap 30' of said plurality of flaps and a second respective portion 16" depicted on a face of a second respective flap 30" of said plurality of flaps 30.

Each reel 14 can include a plurality of first flaps 30' and a plurality of second flaps 30". On each reel there can also be a plurality of flap pairs, each having respective first 30' and respective second flap 30". The first flap 30' of the pair can have the first portion 16' of a game element 16 and the second flap 30" of that same pair can have the second portion 16" of that same game element 16. As further exemplified in FIGS. 6*a*-6*c* each flap 30 can be both a first flap 30' having a first portion 16*a*' of a first game element and a second flap 30" having a second portion 16*b*" of a second game element 16*b*.

With respect to a respective game element 16, the first respective flap 30' can virtually move in the circumferential direction 34 relative to the second respective flap 30" of that pair for that game element. Movement of the first respective flap 30' relative to the second respective flap 30" of the respective game element 16 can change the visual depiction of the respective game element 16, which can be the first game element 16*a*, and can also change the visual depiction of an additional game element, which can be the second game element 16*b*.

The virtual reel 14 having virtual flaps 30 with game elements 16 depicted on the flaps can allow for the variable visual depiction 24 of the associated game elements 16 when the game is in-play to simulate a split-flap reel 14. The movement of the flaps 30 can be generally presented as a "flip action." In particular, when the game is being played, a depiction of a first portion 16*a*' of respective game element 16*a* on a face of a first respective flap 30' can flip in the circumferential direction 34 to reveal an additional game element, and in particular, the first portion 16*b*' of the additional game element 16*b*; when the flap 30' flips completely, the additional game element 16*b*, having portions 16*b*' and 16*b*", can be displayed in a manner where the additional game element 16*b* is in a game orientation 18. Accordingly, the movement of the first flap 30' in the circumferential direction 34 can be described as a "flip action" similar to a the presentation of a split-flap display panel of the type that is traditionally used to present departure and arrival information in some airports and train stations.

Figures 5A, 5B, 5C:
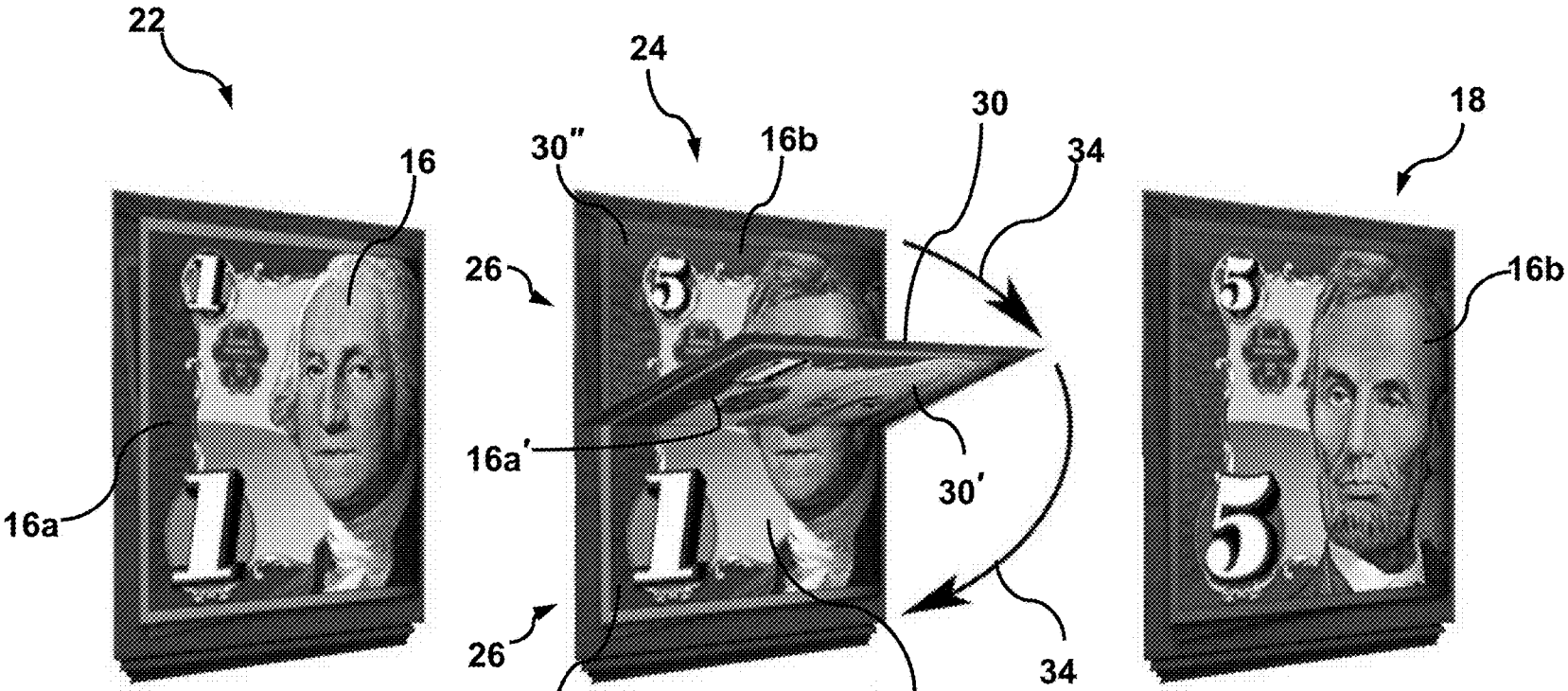
FIGS. 5*a*-5*c* are sequential perspective views of a virtual reel of the gaming machine as game elements change in their depiction.

FIGS. 5*a*-5*c* depict the flip action of a respective game element 16 of a virtual reel 14 in the in-play orientation 22. As illustrated in FIG. 5*a*, the respective game element 16 is a first game element 16*a*. The visual depiction of the first game element 16*a* is a depiction which looks like the depiction of the game element when the element 16*a* is in the game orientation 18. In FIG. 5*b*, the game element's variable visual depiction 24 comprises a differing depiction 26. In this state, the first respective flap 30' having a first respective portion 16*a*' of the first game element 16*a* has moved in the circumferential direction 34 towards the second respective flap 30" having a second respective portion 16*a*" of the first game element. When this occurs, an additional second game element 16*b* can be revealed.

According to such embodiments, game element 16*a* and 16*b* can form part of a composite depiction. In particular, the additional game element 16*b* can comprise a variable visual depiction 24 featuring a differing depiction 26. In addition, the additional game element 16*b* can comprise a first respective flap 30' and a second respective flap 30". FIG. 5*c* illustrates that the second flap 30" can have a second portion 16*b*" of additional game element 16*b* that has completely moved in the circumferential direction 34 away from the first respective flap 30' of the additional game element 16*b* and towards the second respective flap 30" of game element 16*a* to completely reveal additional game element 16*b*. Accordingly, additional element 16*b* can appear as in the game orientation 18.

Figure 2:
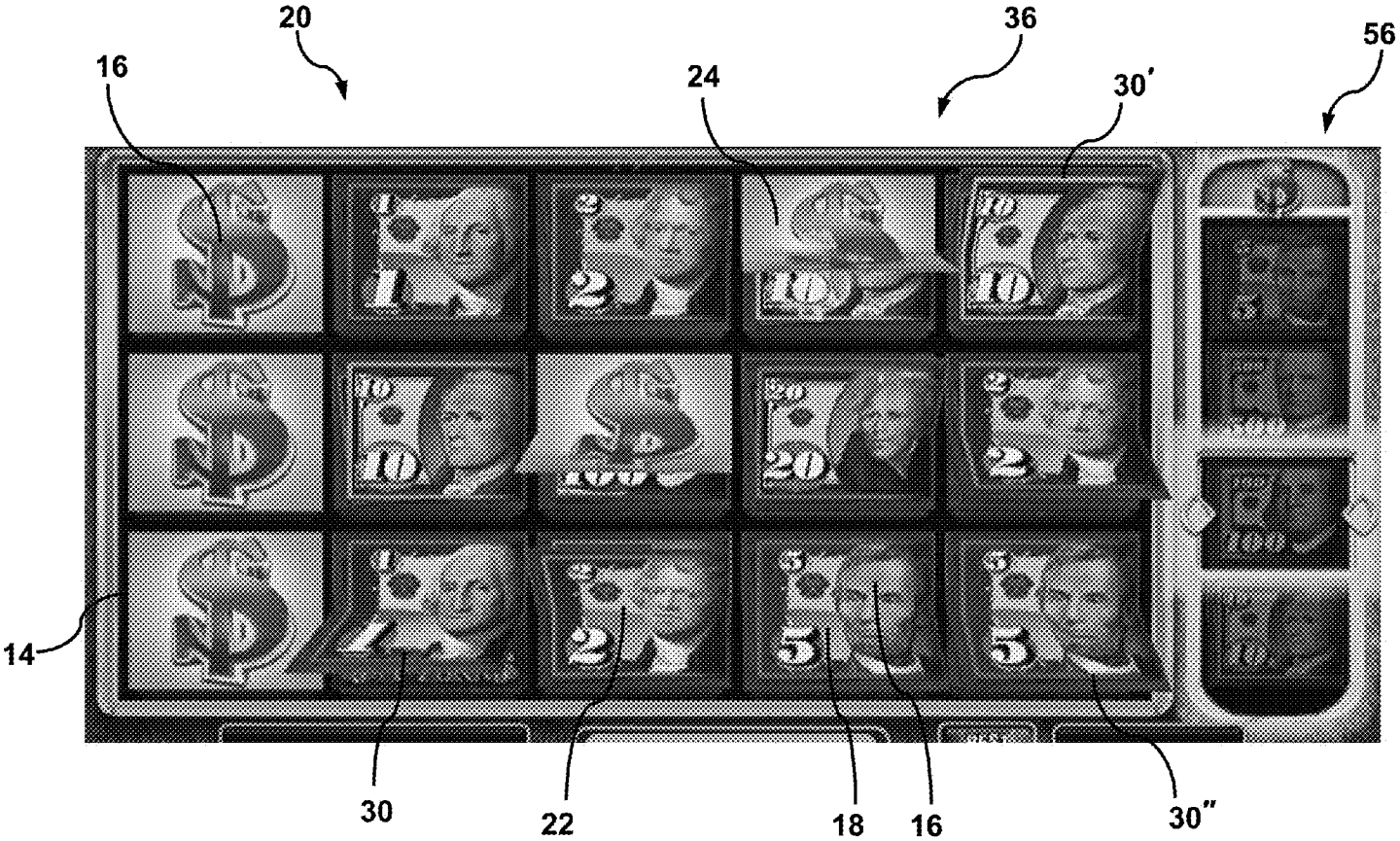
FIG. 2 is a front view of a game display according to embodiments presented herein, wherein some of the game elements of the main array are in a game orientation and some are in an in-play orientation.
Figure 3:
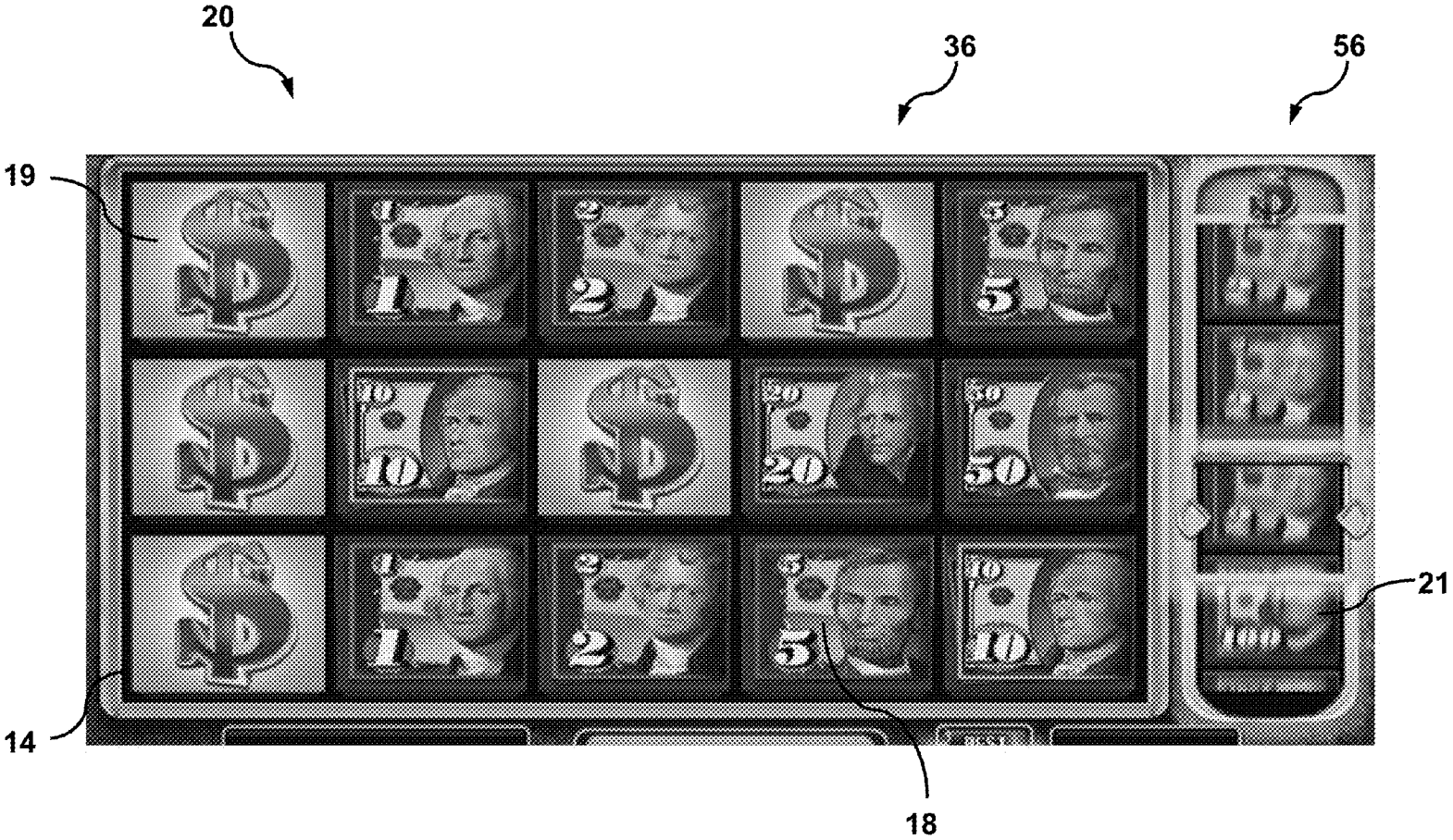
FIG. 3 is a front view of the game display shown in FIG. 2, wherein game elements on the primary array are shown in the game orientation and the secondary array is in an in-play orientation.

FIGS. 2-4 show the progression of the game in-play as it progresses to a win loss determination. In FIG. 2, for example, some of the game elements 16 on the main array 36 have settled into a game orientation, and some of the elements are still in-play. FIG. 3 shows all of the game elements 16, except the dollar signs, in the main array 36 as having settled into the game orientation 18. In such arrangement, play of the game can result with certain reels 14 presenting indicia (shown as dollar signs) 19 associated with initiation or activation of a secondary array or virtual money reel 56. According to such embodiments, the secondary array or virtual money reel 56 can be unlocked and displayed as simulating movement or spinning 21.

FIGS. 4*a* to 4*d* illustrate a display sequence where the secondary array or virtual money reel 56 has produced an outcome 23 associated with a predetermined winning outcome. In particular, according to embodiments presented herein, where the outcome of the secondary array or money reel 56 results in the display of a symbol 23 associated with a predetermined winning outcome 23, the resulting game symbol 23 on the secondary array 56 can be copied and transferred to game positions or reels 14 on main display 36.

Figure 4A:
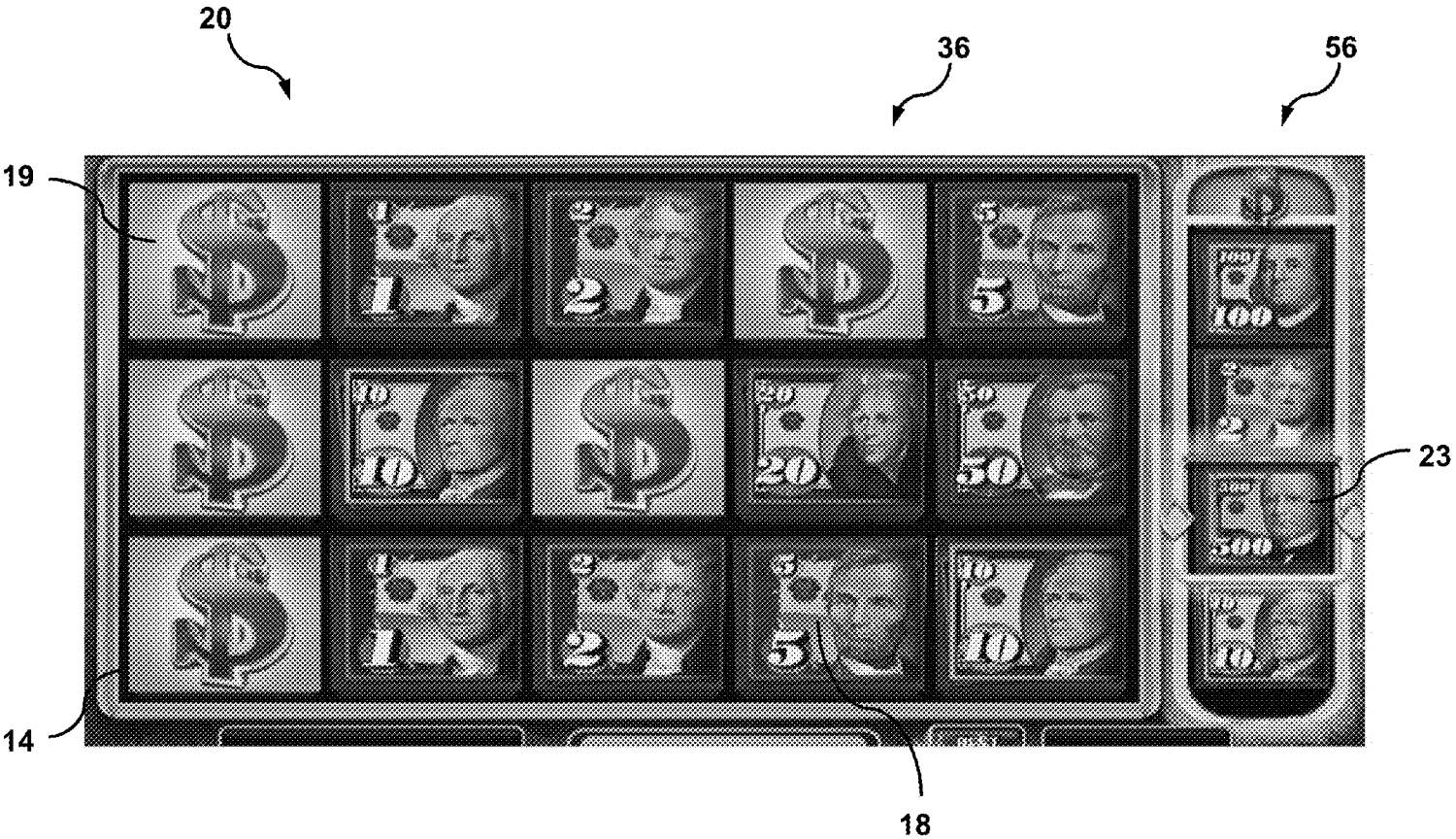
FIG. 4*a* is a first sequential front view of the game display of FIG. 3 wherein the secondary array has stopped in the game orientation.
Figure 4B:
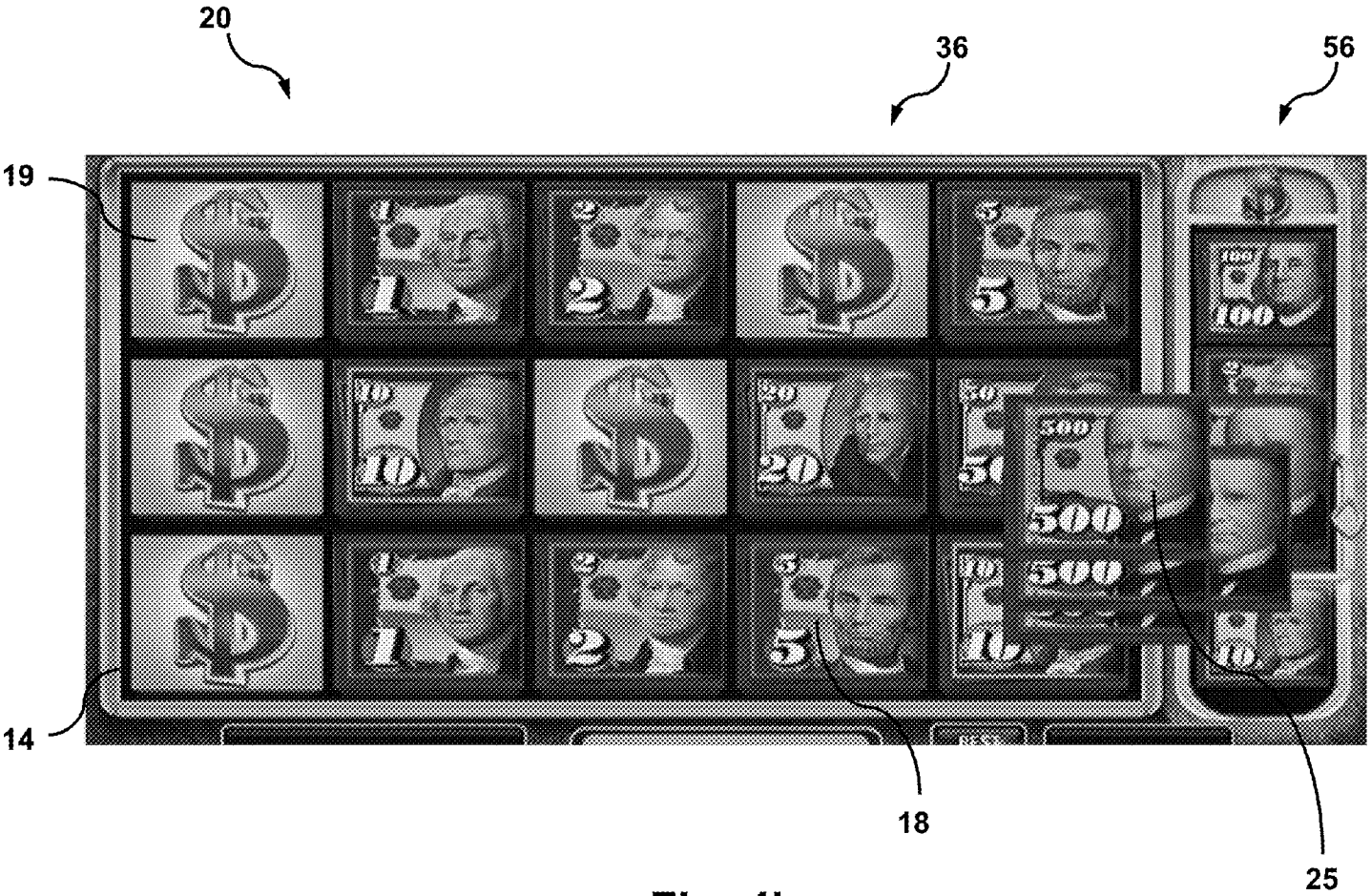
FIG. 4*b* is a second sequential front view of the game display of FIG. 3 wherein copies of the selected game symbol on the secondary array are propagating into the main array.
Figure 4C:
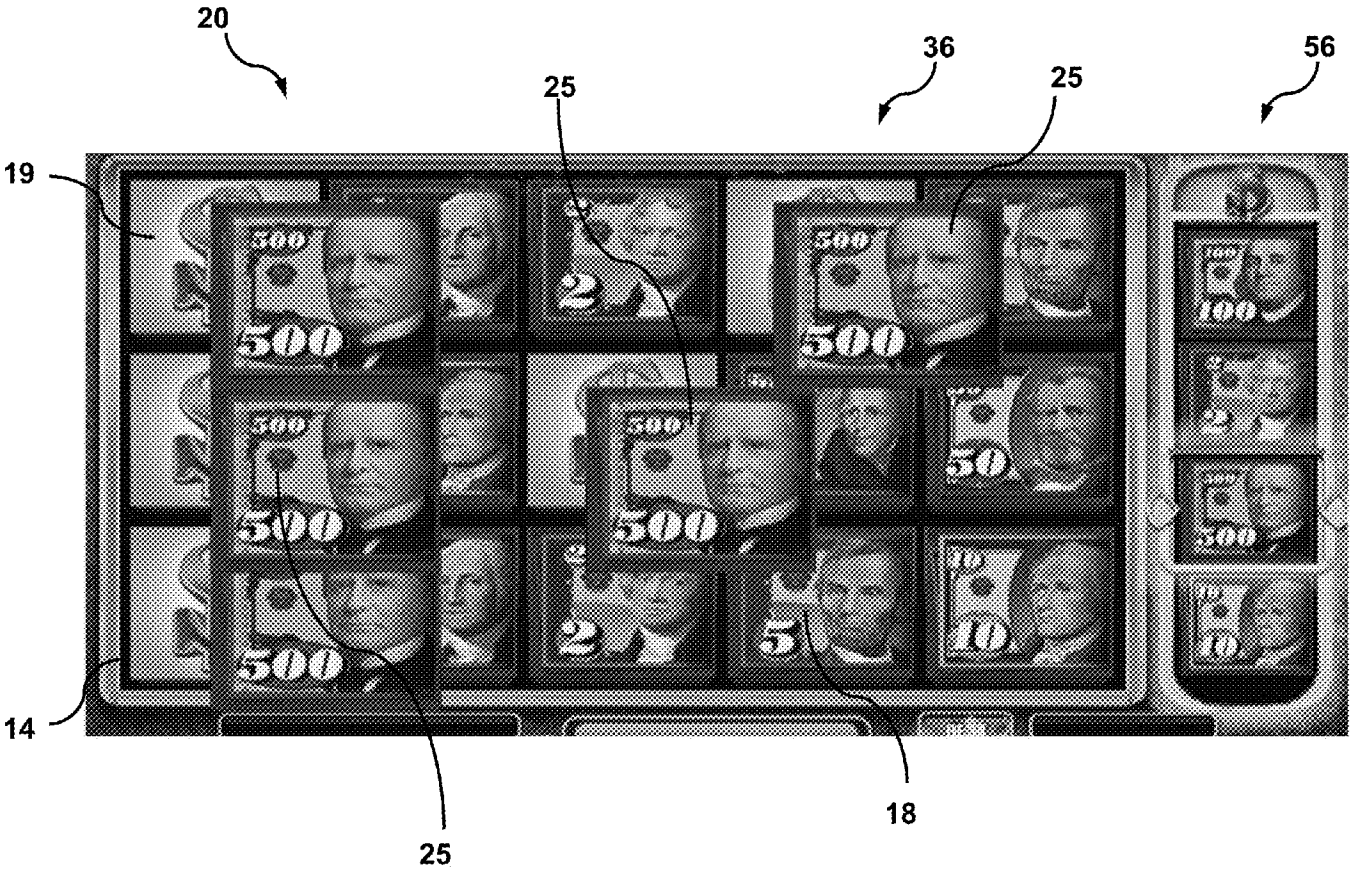
FIG. 4*c* is a third sequential front view of the game display of FIG. 3 wherein copies of the selected game symbol on the secondary array are in the process of populating game positions on the main array.
Figure 4D:
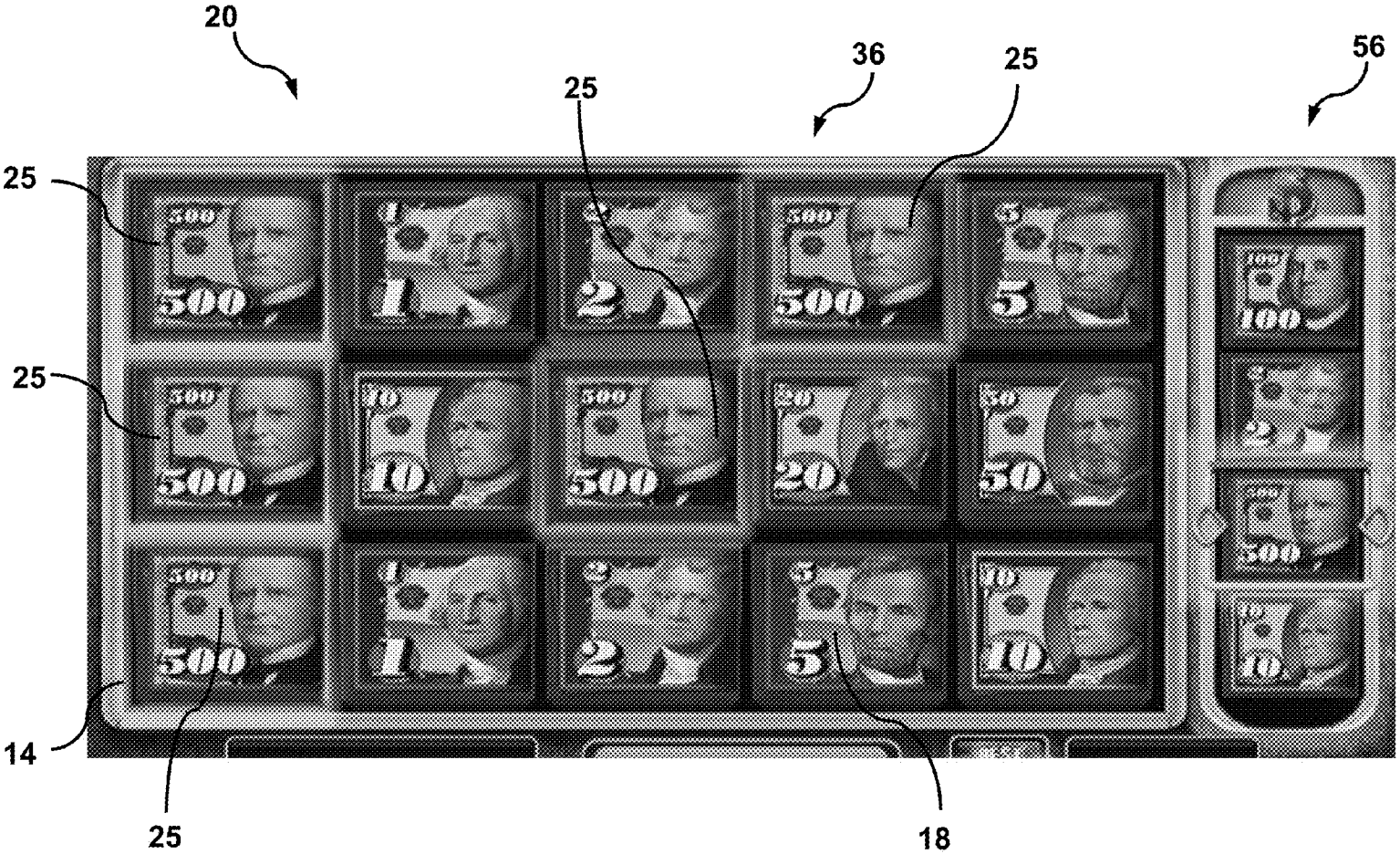
FIG. 4*d* is a fourth sequential front view of the game display of FIG. 3 wherein copies of the selected game symbol on the secondary array are populating game positions on the main array.

As shown in FIGS. 4*b*-4*d*, copies 25 of game symbol 23 can be displayed as moving across the display 20 to populate reels 14 on the main array 26 that have produced dollar symbols 19. When such copies 25 reach the associated reels 14 displaying the dollar symbols 19, the copied symbols 15 can replace the dollar symbols and the display 20 can present indicia to alert or notify an operator that a winning outcome has been produced. For example, FIGS. 4*a*-4*d* illustrate the money reel 56 as having settled on the $500 US currency picture 23. Thus copies 25 of the $500 symbol 23 can be moved across the main array 36 to replace the dollar symbols 19 illustrated in FIG. 3. When this occurs, the dollar symbols 19 can be substituted for the $500 US currency picture and all elements 16 on the main array 36 can be displayed in the game orientation 18, the final configuration being determinative of whether the outcome is a win or a loss.

According to embodiments presented herein, the game can be configured such that five or more identical currency pictures can be associated with a predetermined winning outcome. In addition, the winning outcome can be associated with a prize that corresponds to the value of the currency symbols that have contributed to the winning outcome. Accordingly, in the example illustrated in FIG. 4*d*, the five $500 game symbols can result in a five hundred dollar payout. It will be recognized that such embodiments can increase player excitement by changing the visually observable depiction of game elements 16 as the element on the reel switches from one element to another element when the game is in the in-play mode. It will be further recognized that the inclusion of the supplemental array or money reel 56 to vary payout options can generate additional player excitement.

Figure 6:
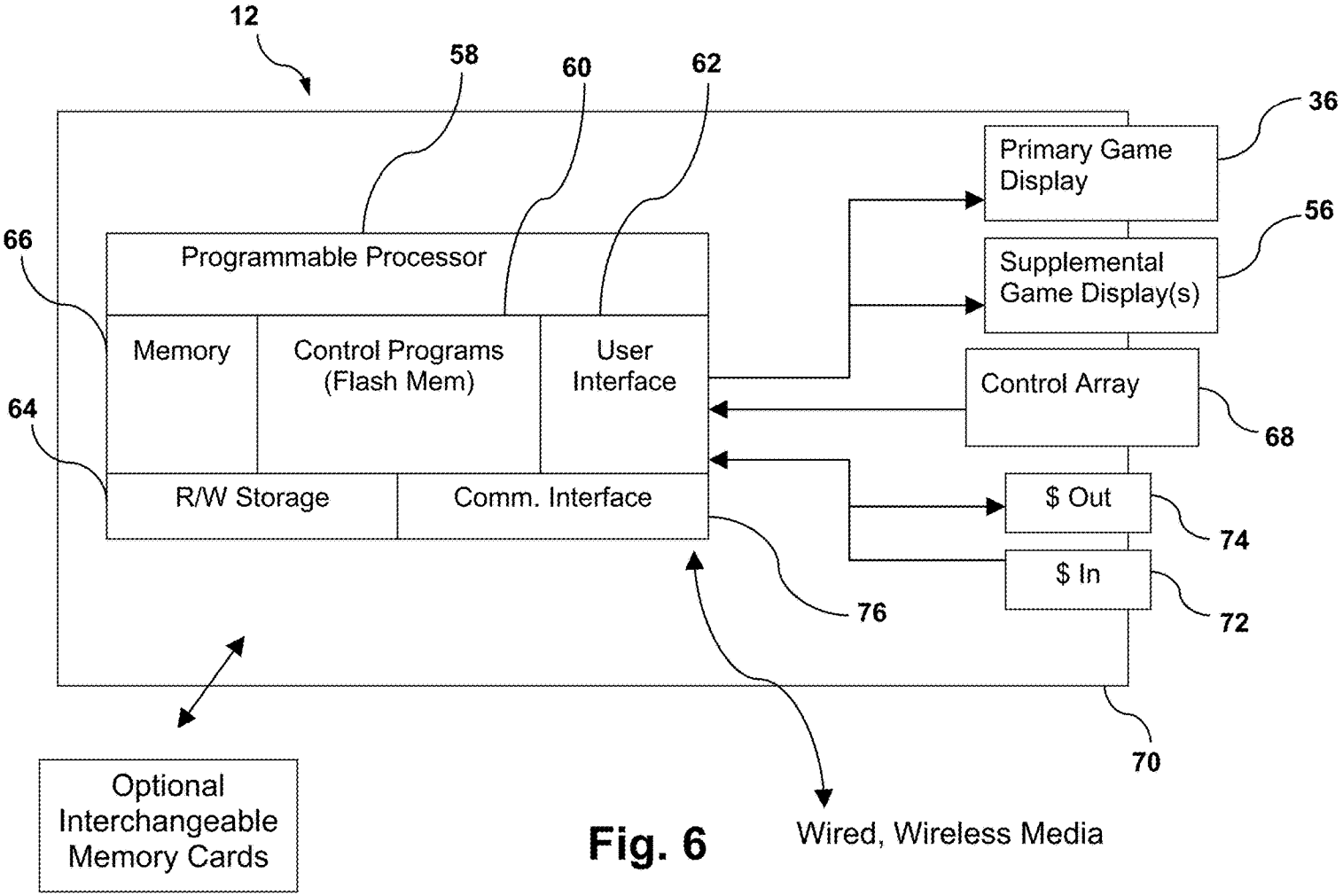
FIG. 6 is a block diagram of a game machine according to embodiments presented herein.

FIG. 6 is a block diagram illustrating the electronic gaming machine ("EGM") according to embodiments of the subject invention. The EGM 12 can include a programmable processor 58 (such as for example a microprocessor or microcontroller) operatively coupled to one or more game displays 34, 56. The processor 58 can include control programs 60 and associated circuitry and be operatively connected to a user interface 62 with input/output circuits and at least one storage unit 64 which can store a plurality of instructions executable by the processor 58. The processor 58 can also include memory 66 which can include a main memory containing dynamic information processed by the processor 58 during operation, and/or a static memory which contains fixed information, such as, for example, an operating system, game programs, and a configuration of information necessary for the processor 58 to register and execute input from a player through a control array 68.

The displays 36, 56 can include any kind of electronic display device suitable for visually presenting dynamic video images or representations of a game played on the EGM 12. The displays 36, 56 can be CRT, LCD, plasma or LED display devices or monitors and can be physically enclosed in the same housing or cabinet 70 as the processor 58 or can be a located outside the cabinet 70 and be operatively coupled to the processor 58. The displays 36, 56 can additionally include touch screen capabilities for receiving input from a player.

The processor 58 can execute the control programs 60 to perform primary functions for play the game, such as for example, randomly selecting game outcomes from a plurality of possible outcomes, recognizing a particular outcome as a predetermined winning or non-winning outcome and/or determining a reward amount associated with a particular winning outcome. The processor 58 can additionally control the game displays 36, 56 by generating static or dynamic video for presentation thereon.

The control array 68 can include one or more input devices, such as for example, a keyboard, mechanical lever, a touch-screen, push buttons or pads and/or any other means for control, or desired combination of controls, able to accept input from a player and produce output to the game displays 36, 56 in response to a player's input.

Where embodiments of the subject invention are practiced or provided in connection with a wagering game, the gaming machine 12 can further include a credit input device 72, such as for example a coin or bill acceptor or card reader and a payout device 74. The credit input device 72 and payout device 74 can be operatively connected to the processor 58 and when money or other credits are deposited in connection with a game, the control program 58 can instruct the payout device to issue an award in response to the selection of certain predetermined winning outcomes of the game. The reward or payoff can be provided in any form, including for example, coins, bills, credits, points, cards, tickets or coupons.

The gaming machine 12 can additionally feature communication means for electrically transmitting signals, including control signals, game data or detected conditions to a remote electronic device such as for example, a computer, network or display device, dedicated storage device, or other mobile electronic device such as a PDA, smart phone, notebook computer or electronic tablet. Such communication means can include a communication interface 76 that can connect the EGM 12 to external electronic devices via wired or wireless communication.

Although embodiments presented herein are generally described in connection with a traditional slot-type gaming machine, and particularly an electronic gaming machine ("EGM"), it will be recognized that the subject invention is not limited to such and can be applied or incorporated for use in connection with any game, gaming machine or system without limitation. Such machines can include, for example: mechanical reel gaming machines; coin-operated amusement devices; bar-top amusement devices; home gaming systems; internet, handheld or mobile-based games, and any other appropriate system.

What is claimed is:

1. An electronic gaming machine comprising:

a payout device configured to provide a reward;

an electronic display screen configured to visually present a virtual display having a primary array displayed jointly alongside a secondary array, the primary array having a plurality of virtual reels having a plurality of predetermined fixed game elements for play of a game, the secondary array having a virtual reel configured for virtual rotation of the fixed game elements to simulate a spinning reel;

a programmable processor coupled to the electronic display screen, the programmable processor having control circuitry for executing instructions stored on a computer-readable medium, an outcome for the game being generated and presented on the electronic display screen by the programmable processor;

the virtual reels of the primary array being displayable in a split-flap configuration providing a first flap section and a second flap section, the first and second flap sections being displayable on the electronic display to virtually rotate separately from one another in a circumferential direction, a predetermined fixed game element of the plurality of predetermined fixed game elements being displayed as a composite depiction across the first and second flap sections, the split-flap configuration and virtual rotation of the first and second flap sections virtually simulating a flip action of a physical split-flap reel having a plurality of physical flaps and a mechanism to actuate said flip action, said virtual flip action being carried out electronically without the physical flaps or the mechanisms, each game element of the plurality of predetermined fixed game element being displayable in a in a by said virtual flip action;

each predetermined fixed game element of said plurality of predetermined fixed game elements displayable on the electronic display screen in a respective game orientation where said predetermined fixed game element is displayed in a visual viewing position and displayed to determine whether said game element is a, or part of a, winning or a losing play;

each predetermined fixed game element of said plurality of predetermined fixed game elements displayable on the electronic display screen in a respective in-play orientation where said game is in-play and said predetermined fixed game element appears to be in motion in said visual viewing position;

when in the in-play orientation each predetermined fixed game element has a depiction, when in said visual viewing position, which differs from another depiction of that same predetermined fixed game element when that same predetermined fixed game element is displayed in the game orientation in said visual viewing position;

a fixed game element from the plurality of fixed game elements being selected from rotation of the virtual reel of the secondary array, said selected fixed game element being virtually copied with said copy of said selected fixed game element being virtually transferred across the virtual display of the electronic display screen from the secondary array to the primary array to occupy a predetermined virtual reel of the plurality of virtual reels of the primary array, said transfer of the selected fixed game element being carried out on the electronic display screen by the joint display of the primary and second arrays without requiring alternating display of the primary and secondary arrays on the electronic display screen or display of the primary and secondary arrays being presented on separate electronic display screens, and wherein the payout device provides the reward in response to the outcome for the game being the winning play, the outcome for said reward being generated by virtual rotation of the virtual reels of the primary array and transition of the virtual reels from the in-play orientation to the game orientation.

2. An electronic gaming machine of claim 1, wherein said composite depiction includes a depiction of an additional predetermined fixed game element of said plurality of predetermined fixed game elements when in the in-play orientation, said additional predetermined fixed game element different from said predetermined fixed game element.

3. An electronic gaming machine of claim 1, wherein the first and second flap sections form a different one of said predetermined fixed game elements of said plurality of predetermined fixed game elements.

4. An electronic gaming machine of claim 3, wherein the first flap section virtually moves in a circumferential direction relative to the second flap when the predetermined fixed game element of that flap pair is in an in-play orientation, movement of the first flap section relative to the second flap section of provides for the depiction of the game element to differ from the other depiction of that same predetermined fixed game element when that same predetermined fixed game element is in the game orientation.

5. An electronic gaming machine of claim 3, wherein each predetermined fixed game element of the plurality of predetermined fixed game elements has a first portion on a face of a different one of the first flap section and a second portion on a face of the second flap section.

6. An electronic gaming machine of claim 1, wherein the depiction of each predetermined fixed game element when in the visual viewing position and in the in-play orientation differs from another depiction of that same predetermined fixed game element in the visual viewing position when in the in-play orientation.

* * * * *